US009554622B2

(12) United States Patent
Cross

(10) Patent No.: US 9,554,622 B2
(45) **Date of Patent: *Jan. 31, 2017**

(54) MULTI-COMPONENT SOLE STRUCTURE HAVING AN AUXETIC CONFIGURATION

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 62 days.

This patent is subject to a terminal disclaimer.

(21) Appl. No.: 14/643,161

(22) Filed: Mar. 10, 2015

(65) Prior Publication Data

US 2015/0237957 A1 Aug. 27, 2015

Related U.S. Application Data

(63) Continuation-in-part of application No. 14/030,002, filed on Sep. 18, 2013, now Pat. No. 9,402,439.

(51) Int. Cl.

| | |
|---|---|
| ***A43B 13/14*** | (2006.01) |
| ***A43B 1/00*** | (2006.01) |
| ***A43B 3/00*** | (2006.01) |
| ***A43B 5/00*** | (2006.01) |
| ***A43B 13/02*** | (2006.01) |

(Continued)

(52) U.S. Cl.

CPC ..... *A43B 13/14* (2013.01); *A43B 1/0009* (2013.01); *A43B 3/0073* (2013.01); *A43B 5/00* (2013.01); *A43B 13/02* (2013.01); *A43B 13/122* (2013.01); *A43B 13/181* (2013.01); *A43B 13/187* (2013.01); *A43B 13/188* (2013.01)

(58) Field of Classification Search

CPC ..... A43X 15/061; A43X 15/06; A43X 15/09; A43X 15/063; A43X 15/12; A43B 13/16; A43B 13/02; A43B 13/181; A43B 13/187; A43B 13/188; A43B 13/122; A43B 1/009; A43B 5/00

See application file for complete search history.

(56) References Cited

U.S. PATENT DOCUMENTS

| | | | |
|---|---|---|---|
| 503,062 | A | 8/1893 | Norwood |
| 1,733,733 | A | 10/1929 | Hess |

(Continued)

FOREIGN PATENT DOCUMENTS

| | | |
|---|---|---|
| CN | 2870531 | 2/2007 |
| CN | 101677651 | 3/2010 |

(Continued)

OTHER PUBLICATIONS

Daniel, Variation from Uniformity, Oct. 15, 2012 https://spacesymmetrystructure.wordpress.com/2012/10/15/variation-from-uniformity/.*

(Continued)

*Primary Examiner* — Shaun R Hurley
*Assistant Examiner* — Bao-Thieu L Nguyen
(74) *Attorney, Agent, or Firm* — Quinn Law Group, PLLC

(57) ABSTRACT

An article of footwear includes a sole structure with a midsole component and an inner sole component. The midsole component includes holes arranged in an auxetic configuration. The midsole component and the inner sole component may have a different density. The midsole component and the inner sole component may have a different compressibility.

20 Claims, 11 Drawing Sheets

(51) Int. Cl.
*A43B 13/12* (2006.01)
*A43B 13/18* (2006.01)

(56) References Cited

U.S. PATENT DOCUMENTS 2,251,468 A * 8/1941 Smith ..... A43B 13/22 36/32 R
2,432,533 A 12/1947 Margolin
2,580,840 A 1/1952 Rogndal
2,963,722 A 12/1960 Stix
3,626,532 A 12/1971 Smith
3,745,600 A 7/1973 Rubico et al.
3,757,436 A 9/1973 Winkler et al.
4,050,108 A 9/1977 Londner
4,272,850 A * 6/1981 Rule ..... A41D 13/065 2/24
4,340,626 A 7/1982 Rudy
4,484,398 A 11/1984 Goodwin et al.
4,668,557 A * 5/1987 Lakes ..... B29C 44/357 264/321
4,756,098 A 7/1988 Boggia
4,858,340 A 8/1989 Pasternak
4,899,412 A 2/1990 Ganon
4,967,492 A 11/1990 Rosen
4,999,931 A 3/1991 Vermeulen
5,060,402 A 10/1991 Rosen
D339,459 S 9/1993 Yoshikawa et al.
D344,170 S 2/1994 Acoff
5,469,639 A 11/1995 Sessa
5,718,064 A 2/1998 Pyle
5,813,146 A 9/1998 Gutkowski et al.
5,918,338 A 7/1999 Wong
D420,786 S 2/2000 Ramer et al.
6,076,282 A * 6/2000 Brue' ..... A43B 7/081 36/141
6,151,804 A 11/2000 Hieblinger
6,178,662 B1 1/2001 Legatzke
6,226,896 B1 5/2001 Friton
6,357,146 B1 3/2002 Wordsworth et al.
6,412,196 B1 * 7/2002 Gross ..... A43B 13/026 36/102
6,412,593 B1 7/2002 Jones
6,487,795 B1 12/2002 Ellis, III
6,564,476 B1 5/2003 Hernandez
D487,614 S 3/2004 Le
D488,916 S 4/2004 McClaskie
6,862,820 B2 3/2005 Farys et al.
7,132,032 B2 11/2006 Tawney et al.
7,160,621 B2 1/2007 Chaudhari et al.
7,191,550 B2 * 3/2007 Baek ..... A43B 7/1425 36/113
7,252,870 B2 8/2007 Anderson et al.
7,254,906 B2 8/2007 Morris et al.
7,310,894 B1 12/2007 Schwarzman et al.
7,377,055 B2 * 5/2008 Bramani ..... A43B 5/145 36/131
D571,543 S 6/2008 Sungadi
7,434,338 B2 * 10/2008 Pfander ..... A43B 7/144 36/141
7,444,766 B2 * 11/2008 Mitchell ..... A43B 13/10 36/28
7,455,567 B2 11/2008 Bentham et al.
7,487,602 B2 2/2009 Berger et al.
7,546,698 B2 6/2009 Meschter
7,574,818 B2 8/2009 Meschter
D614,382 S 4/2010 Grenet et al.
7,770,307 B2 8/2010 Meschter
7,814,852 B2 10/2010 Meschter
7,827,703 B2 11/2010 Geer et al.
7,870,681 B2 1/2011 Meschter
7,870,682 B2 1/2011 Meschter et al.
7,941,939 B2 * 5/2011 Sokolowski ..... A43B 13/187 36/25 R
8,002,879 B2 8/2011 Hook
D653,844 S 2/2012 Smith
8,122,616 B2 2/2012 Meschter et al.
8,132,340 B2 3/2012 Meschter
8,141,276 B2 * 3/2012 Ellis ..... A43B 3/0005 36/103
8,156,663 B2 * 4/2012 Shelton ..... A43B 7/144 36/103
8,186,078 B2 5/2012 Avar et al.
8,196,316 B2 6/2012 Cook et al.
8,220,072 B2 7/2012 Dodd
8,225,530 B2 7/2012 Sokolowski et al.
8,250,784 B2 * 8/2012 Cheskin ..... A43B 7/141 36/144
8,266,827 B2 9/2012 Dojan et al.
8,276,294 B2 10/2012 Polegato Moretti
8,277,719 B2 10/2012 Alderson et al.
8,312,645 B2 11/2012 Dojan et al.
8,316,558 B2 * 11/2012 Teteriatnikov ..... A43B 13/145 36/25 R
8,322,050 B2 12/2012 Lubart
8,333,024 B2 * 12/2012 Fallow ..... A43B 3/0042 36/102
8,343,404 B2 1/2013 Meli et al.
8,388,791 B2 3/2013 Dojan et al.
8,468,720 B2 * 6/2013 Sokolowski ..... A43B 13/125 36/25 R
8,490,299 B2 7/2013 Dua et al.
8,516,723 B2 * 8/2013 Ferrigan ..... A43B 3/0042 36/102
8,544,197 B2 10/2013 Spanks et al.
8,631,589 B2 1/2014 Dojan
8,661,564 B2 3/2014 Dodd
8,707,582 B2 * 4/2014 Klassen ..... A43B 13/181 267/161
8,732,982 B2 5/2014 Sullivan et al.
8,745,894 B2 * 6/2014 Cheskin ..... A43B 1/0009 36/3 R
D707,934 S 7/2014 Petrie
8,844,170 B2 * 9/2014 Ferrigan ..... A43B 3/0042 36/102
D716,027 S 10/2014 Kirschner
D717,034 S 11/2014 Bramani
8,943,708 B2 * 2/2015 Spiller ..... A43B 7/00 36/108
8,950,089 B2 * 2/2015 Youngs ..... A43B 7/34 36/137
8,961,733 B2 2/2015 Dodd
9,044,067 B2 * 6/2015 Edington ..... A43B 7/144
2002/0166262 A1 11/2002 Hernandez
2004/0181972 A1 9/2004 Csorba
2006/0130367 A1 * 6/2006 Liu ..... A43B 1/0009 36/55
2006/0143950 A1 * 7/2006 Beak ..... A43B 13/04 36/97
2007/0213838 A1 9/2007 Hengelmolen
2007/0240333 A1 10/2007 Le et al.
2008/0011021 A1 1/2008 Starbuck et al.
2008/0216357 A1 9/2008 Fogg et al.
2008/0250673 A1 10/2008 Andrews et al.
2008/0289214 A1 11/2008 Aveni
2009/0064536 A1 3/2009 Klassen et al.
2009/0064540 A1 3/2009 Sokolowski et al.
2009/0100722 A1 * 4/2009 Hoffer ..... A43B 1/0009 36/3 R
2009/0119820 A1 5/2009 Bentham et al.
2009/0151195 A1 6/2009 Forstrom et al.
2009/0178301 A1 7/2009 Dojan et al.
2009/0183392 A1 7/2009 Shane
2009/0276933 A1 11/2009 Dodd
2009/0307932 A1 12/2009 Kirby et al.
2010/0029796 A1 2/2010 Alderson et al.
2010/0043255 A1 2/2010 Trevino
2010/0095551 A1 * 4/2010 Gupta ..... A43B 7/144 36/29
2010/0107448 A1 * 5/2010 Fallow ..... A43B 3/0042 36/103
2010/0126041 A1 5/2010 Francis
2010/0139122 A1 6/2010 Zanatta

(56) References Cited

U.S. PATENT DOCUMENTS

| | | | | |
|---|---|---|---|---|
| 2010/0170117 | A1 | 7/2010 | Kim | |
| 2010/0236098 | A1 | 9/2010 | Morgan | |
| 2010/0293815 | A1* | 11/2010 | Ferrigan | A43B 3/0042 36/25 R |
| 2011/0099845 | A1 | 5/2011 | Miller | |
| 2011/0119956 | A1 | 5/2011 | Borel et al. | |
| 2011/0168313 | A1 | 7/2011 | Ma et al. | |
| 2011/0192056 | A1 | 8/2011 | Geser et al. | |
| 2011/0247237 | A1 | 10/2011 | Jara et al. | |
| 2011/0247240 | A1 | 10/2011 | Eder et al. | |
| 2012/0021167 | A1 | 1/2012 | Plant | |
| 2012/0023686 | A1 | 2/2012 | Huffa et al. | |
| 2012/0117826 | A1 | 5/2012 | Jarvis | |
| 2012/0124861 | A1* | 5/2012 | Losani | A43B 7/08 36/28 |
| 2012/0124865 | A1 | 5/2012 | Opie et al. | |
| 2012/0129416 | A1 | 5/2012 | Anand et al. | |
| 2012/0159810 | A1 | 6/2012 | Klassen | |
| 2012/0174432 | A1 | 7/2012 | Peyton | |
| 2012/0181896 | A1 | 7/2012 | Kornbluh et al. | |
| 2012/0198720 | A1 | 8/2012 | Farris et al. | |
| 2012/0210607 | A1 | 8/2012 | Avar et al. | |
| 2012/0233878 | A1 | 9/2012 | Hazenberg et al. | |
| 2012/0266492 | A1 | 10/2012 | Youngs et al. | |
| 2012/0272550 | A1 | 11/2012 | Parce | |
| 2012/0315456 | A1 | 12/2012 | Scarpa et al. | |
| 2013/0000152 | A1 | 1/2013 | Cooper et al. | |
| 2013/0071583 | A1 | 3/2013 | Evans et al. | |
| 2013/0081305 | A1 | 4/2013 | Byrne | |
| 2013/0104428 | A1 | 5/2013 | O'Brien et al. | |
| 2013/0160324 | A1 | 6/2013 | Peyton et al. | |
| 2013/0160328 | A1 | 6/2013 | Hatfield et al. | |
| 2013/0219636 | A1 | 8/2013 | Dojan et al. | |
| 2013/0239444 | A1 | 9/2013 | Polegato Moretti | |
| 2013/0276333 | A1 | 10/2013 | Wawrousek et al. | |
| 2013/0284732 | A1 | 10/2013 | Van Schaftingen | |
| 2013/0340288 | A1 | 12/2013 | Baker et al. | |
| 2014/0053311 | A1 | 2/2014 | Nordstrom et al. | |
| 2014/0053312 | A1 | 2/2014 | Nordstrom et al. | |
| 2014/0059734 | A1* | 3/2014 | Toronjo | A41D 31/005 2/69 |
| 2014/0075779 | A1* | 3/2014 | Bruce | A43B 13/20 36/29 |
| 2014/0090271 | A1* | 4/2014 | Hoffer | A43B 1/0009 36/29 |
| 2014/0101816 | A1 | 4/2014 | Toronjo | |
| 2014/0157631 | A1 | 6/2014 | Dodd | |
| 2014/0165427 | A1 | 6/2014 | Molyneux et al. | |
| 2014/0173938 | A1 | 6/2014 | Beye et al. | |
| 2014/0182166 | A1* | 7/2014 | Ellis, III | A43B 3/0005 36/29 |
| 2014/0196308 | A1* | 7/2014 | Baratta | A43B 13/184 36/29 |
| 2014/0237850 | A1 | 8/2014 | Hull | |
| 2014/0260281 | A1 | 9/2014 | Innes | |
| 2015/0007456 | A1* | 1/2015 | Klassen | A43B 13/181 36/102 |
| 2015/0075033 | A1 | 3/2015 | Cross et al. | |
| 2015/0075034 | A1 | 3/2015 | Cross et al. | |
| 2015/0181976 | A1* | 7/2015 | Cooper | A43B 13/187 36/28 |
| 2015/0237959 | A1* | 8/2015 | Wynn | A43B 7/142 36/44 |
| 2016/0021972 | A1* | 1/2016 | Grelle | A43B 3/0057 36/140 |

FOREIGN PATENT DOCUMENTS

| | | | |
|---|---|---|---|
| GB | 2 147 792 | A | 5/1985 |
| GB | 2 455 167 | A | 6/2009 |
| GB | 2 463 446 | A | 3/2010 |
| JP | 2005-143637 | A | 6/2005 |
| KR | 101165793 | | 7/2012 |
| TW | 201231283 | | 8/2012 |
| WO | 03/022085 | A2 | 3/2003 |
| WO | 2007022338 | A1 | 2/2007 |
| WO | 2007/052054 | A1 | 5/2007 |
| WO | 2012/171911 | A1 | 12/2012 |
| WO | 2014187970 | | 11/2014 |
| WO | 2015/041796 | A1 | 3/2015 |
| WO | 2016007205 | A1 | 1/2016 |
| WO | 2016032626 | A1 | 3/2016 |

OTHER PUBLICATIONS

International Search Report and Written Opinion mailed Apr. 6, 2016 in PCT Application No. PCTUS2015/066883.

International Search Report and Written Opinion mailed Apr. 6, 2016 in PCT Application No. PCTUS2015/066923.

International Search Report and Written Opinion mailed Apr. 13, 2016 in PCT Application No. PCTUS2015/066895.

Taiwanese Office Action dated Mar. 1, 2016 in Taiwanese Patent Application No. 103131046.

International Search Report and Written Opinion mailed Dec. 4, 2014 in PCT/US2014/052038.

Office Action mailed Mar. 26, 2015 in U.S. Appl. No. 14/030,002.

International Search Report and Written Opinion mailed Mar. 18, 2016 in PCT Application No. PCTUS2015/066901.

International Search Report and Written Opinion mailed Mar. 18, 2016 in PCT Application No. PCTUS2015/066913.

International Preliminary Report on Patentability (including Written Opinion of the ISA) dated Mar. 22, 2016 in PCT Application No. PCTUS2014/052038.

International Search Report and Written Opinion mailed Mar. 18, 2016 in PCT Application No. PCTUS2015/066905.

International Search Report and Written Opinion mailed Oct. 14, 2015 in PCT/US2015/038958.

International Search Report and Written Opinion mailed Nov. 17, 2015 in PCT/US2015/040523.

* cited by examiner

MULTI-COMPONENT SOLE STRUCTURE HAVING AN AUXETIC CONFIGURATION

CROSS-REFERENCE TO RELATED APPLICATIONS

This application is a continuation-in-part of U.S. patent application Ser. No. 14/030,002, filed Sep. 18, 2013, also titled "Auxetic Structures and Footwear with Soles Having Auxetic Structures," the entirety of which is herein incorporated by reference. This application is related to co-pending U.S. patent application Ser. No. 14/643,089, filed Mar. 10, 2015, titled "Midsole Component and Outer Sole Members with Auxetic Structure," the entirety of which is herein incorporated by reference. This application is also related to co-pending U.S. patent application Ser. No. 14/643,121, filed Mar. 10, 2015, titled "Sole Structure with Holes Arranged in Auxetic Configuration," the entirety of which is herein incorporated by reference.

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, a sole structure includes a midsole component and an inner sole component. The midsole component includes a plurality of holes arranged in an auxetic configuration. The midsole component is shaped to receive the inner sole component and a first density of the midsole component is different than a second density of the inner sole component.

In another aspect, an article of footwear includes an upper and a sole structure with a midsole component and an inner sole component. The midsole component includes an outer surface and an inner surface. The outer surface includes a plurality of holes arranged in an auxetic configuration. The inner surface includes a central recess that receives the inner sole component. At least one outer sole member is attached to the outer surface of the midsole component.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
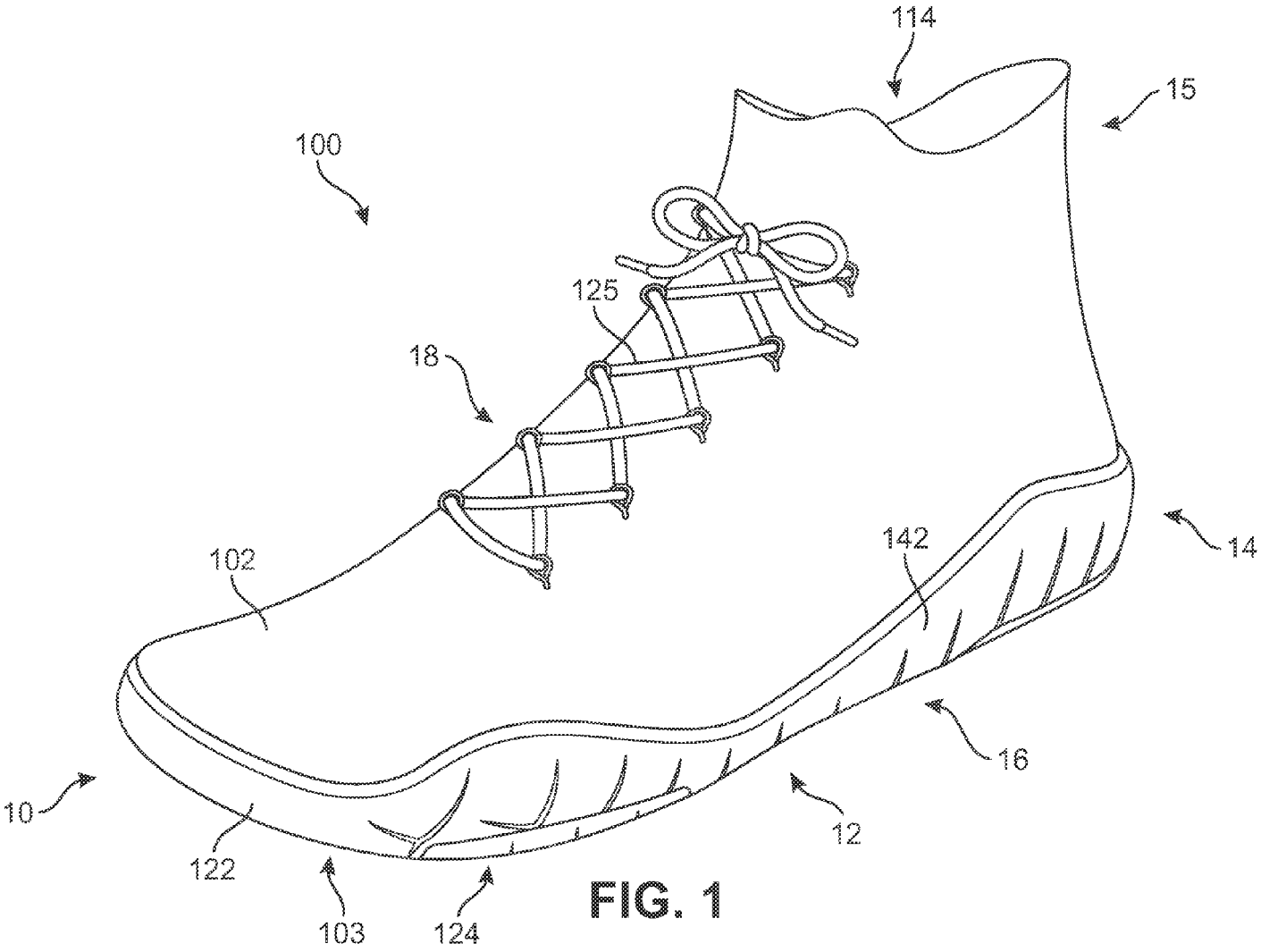
FIG. 1 is an isometric view of an embodiment of an article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of an inner sole component, a midsole component, an outer sole component, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14 and ankle portion 15.

Figure 2:
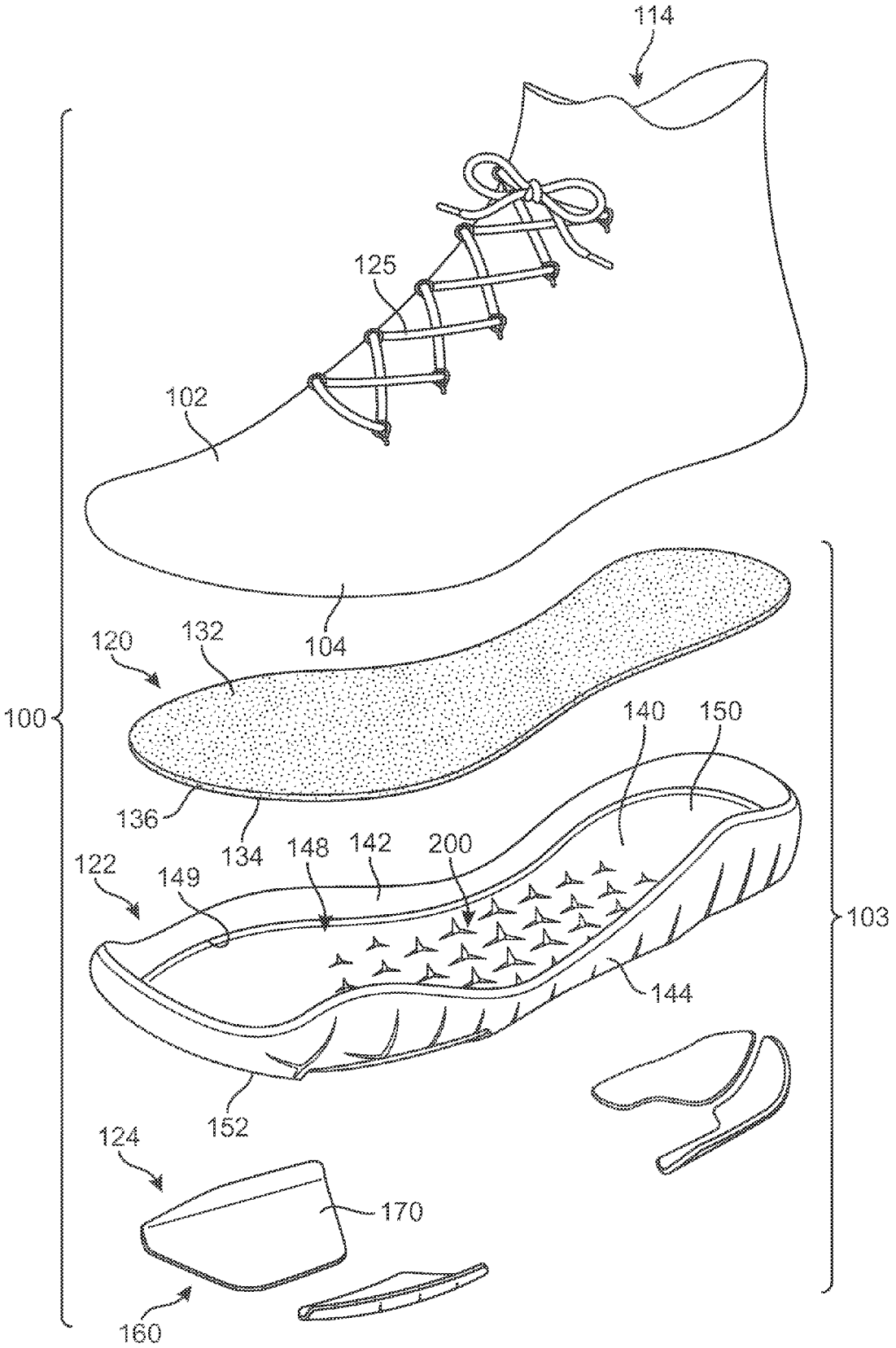
FIG. 2 is an exploded isometric view of an embodiment of an article of footwear.

FIG. 2 illustrates an exploded isometric view of an embodiment of article of footwear 100. FIGS. 1-2 illustrate various components of article of footwear 100, including an upper 102 and a sole structure 103.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, upper 102 includes opening 114 that provides entry for the foot into an interior cavity of upper 102. In some embodiments, upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

Some embodiments may include uppers that extend beneath the foot, thereby providing 360 degree coverage at some regions of the foot. However, other embodiments need not include uppers that extend beneath the foot. In other embodiments, for example, an upper could have a lower periphery joined with a sole structure and/or sock liner.

An upper could be formed from a variety of different manufacturing techniques resulting in various kinds of upper structures. For example, in some embodiments, an upper could have a braided construction, a knitted (e.g., warp-knitted) construction or some other woven construction. In an exemplary embodiment, upper 102 may be a knitted upper.

In some embodiments, sole structure 103 may be configured to provide traction for article 100. In addition to providing traction, sole structure 103 may attenuate ground reaction forces when compressed between the foot and the ground during walking, running or other ambulatory activities. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to: natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In the exemplary embodiment shown in FIGS. 1-2, sole structure 103 may include inner sole component 120, midsole component 122 and a plurality of outer sole members 124. In some cases, one or more of these components may be optional.

Referring now to FIG. 2, in some embodiments, inner sole component 120 may be configured as an inner layer for a midsole. For example, as discussed in further detail below, inner sole component 120 may be integrated, or received, into a portion of midsole component 122. However, in other embodiments, inner sole component 120 could function as an insole layer and/or as a strobel layer. Thus, in at least some embodiments, inner sole component 120 could be joined (e.g., stitched or glued) to lower portion 104 of upper 102 for purposes of securing sole structure 103 to upper 102.

Inner sole component 120 may have an inner surface 132 and an outer surface 134. Inner surface 132 may generally be oriented towards upper 102. Outer surface 134 may be generally oriented towards midsole component 122. Furthermore, a peripheral sidewall surface 136 may extend between inner surface 132 and outer surface 134.

Midsole component 122 may be configured to provide cushioning, shock absorption, energy return, support, as well as possibly other provisions. To this end, midsole component 122 may have a geometry that provides structure and support for article 100. Specifically, midsole component 122 may be seen to have a lower portion 140 and a sidewall portion 142. Sidewall portion 142 may extend around the entire periphery 144 of midsole component 122. As seen in FIG. 1, sidewall portion 142 may partially wrap up the sides of article 100 to provide increased support along the base of the foot.

Midsole component 122 may further include an inner surface 150 and an outer surface 152. Inner surface 150 may be generally oriented towards upper 102, while outer surface 152 may be oriented outwardly. Furthermore, in the exemplary embodiment, midsole component 122 includes a central recess 148 disposed in inner surface 150. Central recess 148 may generally be sized and configured to receive inner sole component 120.

In some embodiments, midsole component 122 may include a plurality of holes 200, at least some of which may extend through the entire thickness of midsole component 122. In the exemplary embodiment shown in FIG. 2, some of the plurality of holes 200 are visible within central recess 148.

In different embodiments, midsole component 122 may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

Figure 3:
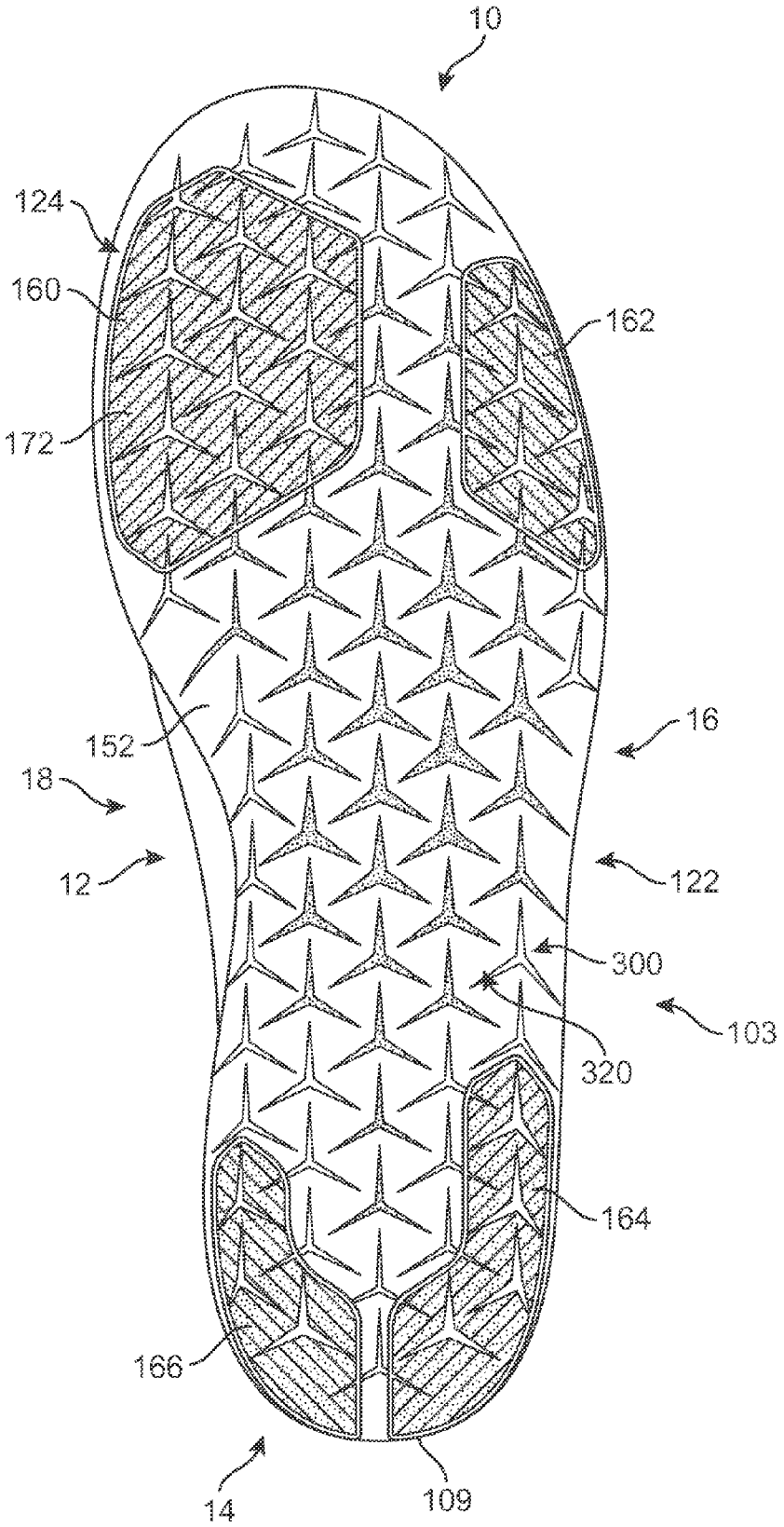
FIG. 3 is a bottom view of an embodiment of an article of footwear.

FIG. 3 illustrates a bottom view of sole structure 103. As seen in FIGS. 2-3, plurality of outer sole members 124 comprises four distinct outer sole members. Specifically, sole structure 103 includes a first outer sole member 160, a second outer sole member 162, a third outer sole member 164 and a fourth outer sole member 166. Although the exemplary embodiment includes four different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, five or more outer sole members could be used.

Generally, an outer sole member may be configured as a ground contacting member. In some embodiments, an outer sole member could include properties associated with outsoles, such as durability, wear-resistance and increased traction. In other embodiments, an outer sole member could include properties associated with a midsole, including cushioning, strength and support. In the exemplary embodiment, plurality of outer sole members 124 may be configured as outsole-like members that enhance traction with a ground surface while maintaining wear resistance.

In different embodiments, the locations of one or more outer sole members could vary. In some embodiments, one or more outer sole members could be disposed in a forefoot portion of a sole structure. In other embodiments, one or more outer sole members could be disposed in a midfoot portion of a sole structure. In still other embodiments, one or more outer sole members could be disposed in a heel portion of a sole structure. In an exemplary embodiment, first outer sole member 160 and second outer sole member 162 may be disposed in forefoot portion 10 of sole structure 103. More specifically, first outer sole member 160 may be disposed on medial side 18 of forefoot portion 10, while second outer sole member 162 may be disposed on lateral side 16 of forefoot portion 10. In addition, in the exemplary embodiment third outer sole member 164 and fourth outer sole member 166 may be disposed in heel portion 14 of sole structure 103. More specifically, third outer sole member 164 may be disposed on lateral side 16 and fourth outer sole member 166 may be disposed on medial side 18. Furthermore, it can be seen that first outer sole member 160 and second outer sole member 162 are spaced apart from one another in the center of forefoot portion 10, while third outer sole member 164 and fourth outer sole member 166 are spaced apart from one another in the center of heel portion 14. This exemplary configuration provides outer sole members at areas of increased ground contact during various lateral and medial cuts, so as to enhance traction during these motions.

The sizes of various outer sole members could vary. In the exemplary embodiment, first outer sole member 160 may be the largest outer sole member of plurality of outer sole members 124. Moreover, second outer sole member 162 may be substantially smaller than first outer sole member 160 thereby enhancing traction more on a medial side 18 of sole structure 103 than on lateral side 16 in forefoot portion 10. At heel portion 14, third outer sole member 164 and fourth outer sole member 166 are both widest along a rearward edge 109 of sole structure 103, and taper slightly towards midfoot portion 12.

Referring to FIGS. 2 and 3, first outer sole member 160 may be seen to have an inner surface 170 and an outer surface 172. Inner surface 170 may generally be disposed against midsole component 122. Outer surface 172 may face outwardly and may be a ground contacting surface. For purposes of clarity, only the inner and outer surfaces of first outer sole member 160 are indicated in FIGS. 2-3, however it will be understood that the remaining outer sole members may likewise include corresponding inner and outer surfaces that have similar orientations with respect to midsole component 122.

In the exemplary embodiment, inner sole component 120 may be disposed within central recess 148 of midsole component 122. More specifically, outer surface 134 of inner sole component 120 may be oriented towards, and be in contact with, inner surface 150 of midsole component 122. Furthermore, in some cases, peripheral sidewall surface 136 may also contact inner surface 150 along an inner recess sidewall 149. In addition, plurality of outer sole members 124 may be disposed against outer surface 152 of midsole component 122. For example, inner surface 170 of first outer sole member 160 may face towards, and be in contact with, outer surface 152 of midsole component 122. In some embodiments, when assembled, midsole component 122 and inner sole component 120 could comprise a composite midsole assembly, or dual layered midsole assembly.

In different embodiments, upper 102 and sole structure 103 could be joined in various ways. In some embodiments, upper 102 could be joined to inner sole component 120, e.g., using an adhesive or by stitching. In other embodiments, upper 102 could be joined to midsole component 122, for example, along sidewall portion 142. In still other embodiments, upper 102 could be joined with both inner sole component 120 and midsole component 122. Moreover, these components may be joined using any methods known in the art for joining sole components with uppers, including various lasting techniques and provisions (e.g., board lasting, slip lasting, etc.).

In different embodiments, the attachment configurations of various components of article 100 could vary. For example, in some embodiments, inner sole component 120 could be bonded or otherwise attached to midsole component 122. Such bonding or attachment could be accomplished using any known methods for bonding components of articles of footwear, including, but not limited to: adhesives, films, tapes, staples, stitching, or other methods. In some other embodiments, it is contemplated that inner sole component 120 may not be bonded or attached to midsole component 122, and instead could be free-floating. In at least some embodiments, inner sole component 120 may have a friction fit with central recess 148 of midsole component 122.

Outer sole members 124 may be likewise be bonded or otherwise attached to midsole component 122. Such bonding or attachment could be accomplished using any known methods for bonding components of articles of footwear, including, but not limited to: adhesives, films, tapes, staples, stitching, or other methods.

It is contemplated that in at least some embodiments, two or more of inner sole component 120, midsole component 122 and/or outer sole members 124 could be formed and/or bonded together during a molding process. For example, in some embodiments, upon forming midsole component 122, inner sole component 120 could be molded within central recess 148.

Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Sole structure 103 as shown in FIGS. 1-5 and as described further in detail below, has an auxetic structure or configuration. Sole structures comprising auxetic structures are described in Cross, U.S. patent application Ser. No. 14/030,002, filed Sep. 18, 2013 and entitled "Auxetic Structures and Footwear with Soles Having Auxetic Structures" (the "Auxetic Structures application"), the entirety of which is hereby incorporated by reference.

Figure 4:
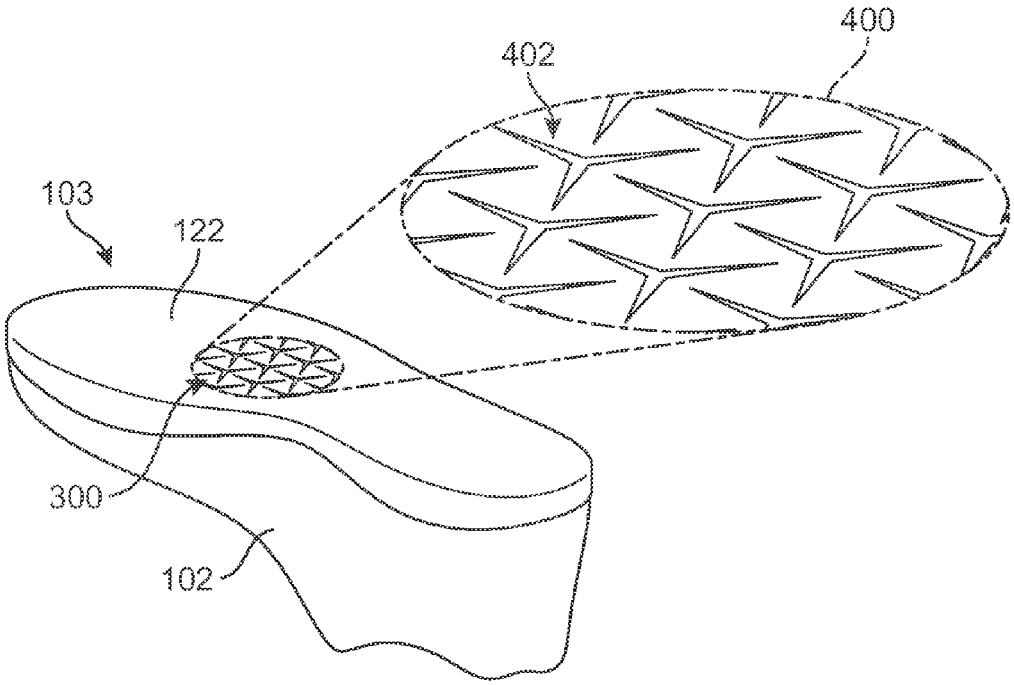
FIG. 4 is a bottom isometric view of an embodiment of a sole component including an enlarged schematic view of a portion of the sole component.
Figure 5:
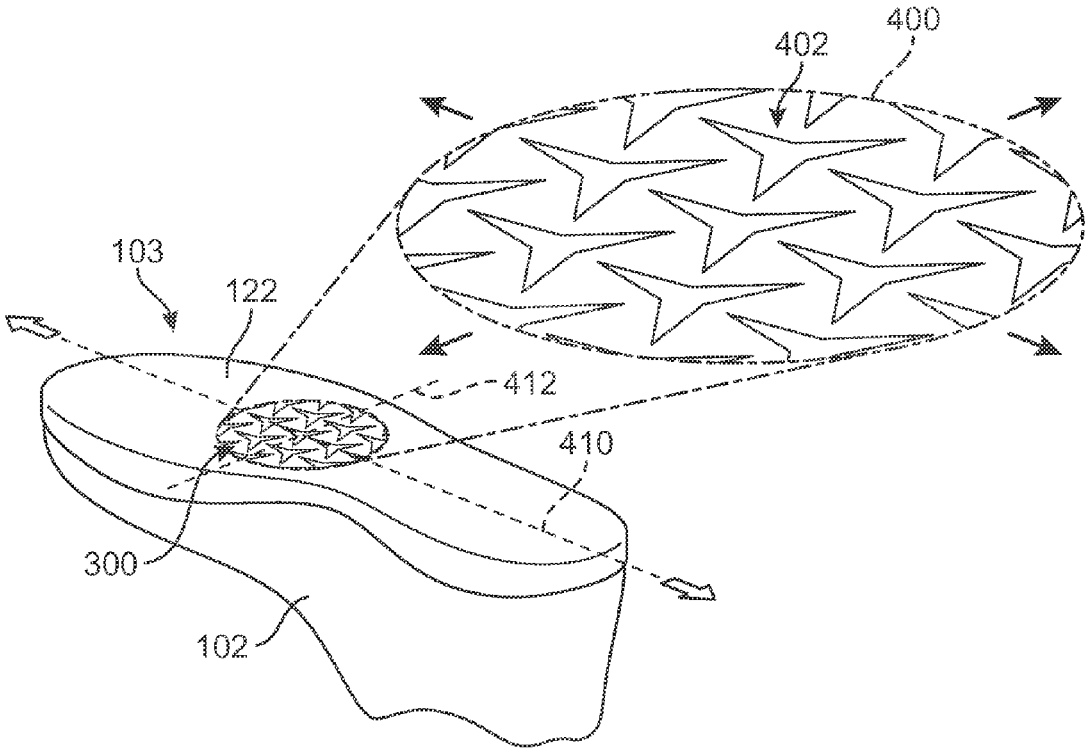
FIG. 5 is a bottom isometric view of an embodiment of a sole component including an enlarged schematic view of a portion of the sole component, in which the portion of the sole component is undergoing auxetic expansion.

As described in the Auxetic Structures application, auxetic materials have a negative Poisson's ratio, such that when they are under tension in a first direction, their dimensions increase both in the first direction and in a second direction orthogonal or perpendicular to the first direction. This property of an auxetic material is illustrated in FIGS. 4 and 5.

As seen in FIG. 3, sole structure 103 may include a plurality of holes 300. As used herein, the term "hole" refers to any hollowed area or recessed area in a component. In some cases, a hole may be a through hole, in which the hole extends between two opposing surfaces of a component. In other cases, a hole may be a blind-hole, in which the hole may not extend through the entire thickness of the component and may therefore only be open on one side. Moreover, as discussed in further detail below, a component may utilize a combination of through holes and blind-holes. Furthermore, the term "hole" may be used interchangeably in some cases with "aperture" or "recess".

In regions including one or more holes, sole structure 103 may be further associate with a plurality of discrete sole portions 320. Specifically, sole portions 320 comprise the portions of sole structure 103 that extend between plurality of holes 300. It may also be seen that plurality of holes 300 extend between sole portions 320. Thus it may be understood that each hole may be surrounded by a plurality of sole portions, such that the boundary of each hole may be defined by the edges of the sole portions. This arrangement between holes (or apertures) and sole portions, is discussed in further detail in the Auxetic Structures application.

As seen in FIG. 3, plurality of holes 300 may extend through a majority of midsole component 122. In some embodiments, plurality of holes 300 may extend through forefoot portion 10, midfoot portion 12 and heel portion 14 of midsole component 122. In other embodiments, plurality of holes 300 may not extend through each of these portions.

Plurality of holes 300 may also extend through plurality of outer sole members 124. In the exemplary embodiment, each of first outer sole member 160, second outer sole member 162, third outer sole member 164 and fourth outer sole member 166 includes two or more holes. However, in other embodiments, one or more outer sole members may not include any holes.

In different embodiments, the geometry of one or more holes could vary. Examples of different geometries that could be used for an auxetic sole structure are disclosed in the Auxetic Structures application. Moreover, embodiments could also utilize any other geometries, such as utilizing sole portions with parallelogram geometries or other polygonal geometries that are arranged in a pattern to provide the sole with an auxetic structure. In the exemplary embodiment, each hole of plurality of holes 300 has a tri-star geometry, including three arms or points extending from a common center.

The geometry of one or more sole portions could also vary. Examples of different geometries that could be used for an auxetic sole structure are disclosed in the Auxetic Structures application. It may be understood that the geometry of a sole portion may be determined by the geometry of the holes in an auxetic pattern, and vice versa. In the exemplary embodiment, each sole portion has an approximately triangular geometry.

Plurality of holes 300 may be arranged on sole structure 103 in an auxetic pattern, or auxetic configuration. In other words, plurality of holes 300 may be arranged on midsole component 122 and/or outer sole members 124 in a manner that allows those components to undergo auxetic motions, such as expansion or contraction. An example of auxetic expansion, which occurs as the result of the auxetic configuration of plurality of holes 300, is shown in FIGS. 4 and 5. Initially, in FIG. 4, sole structure 103 is in a non-tensioned state. In this state, plurality of holes 300 have an untensioned area. For purposes of illustration, only a region 400 of midsole component 122 is shown, where region 400 includes a subset of holes 402.

As tension is applied across sole structure 103 along an exemplary linear direction 410 (e.g., a longitudinal direction), as shown in FIG. 5, sole structure 103 undergoes auxetic expansion. That is, sole structure 103 expands along direction 410, as well as in a second direction 412 that is perpendicular to direction 410. In FIG. 5, the representative region 400 is seen to expand in both direction 410 and direction 412 simultaneously, as holes 402 increase in size.

Embodiments can include provisions for a dual layer midsole structure. In some embodiments, a midsole component can be configured to mate with, or otherwise engage, an inner sole component such that the two components comprise a single midsole structure or other similar sole structure. Moreover, the two layers can be configured with different properties such as different densities, different degrees of compressibility as well as possibly other material characteristics.

As previously discussed and shown in FIG. 2, inner sole component 120 may be configured to fit within central recess 148 of midsole component 122. In particular, central recess 148 is sized to fit inner sole component 120. Moreover, in some embodiments, central recess 148 may extend the full length of sole structure 103, which is from a front end 107 to a rearward end 108 of sole structure 103 (see FIG. 6).

Figure 6:
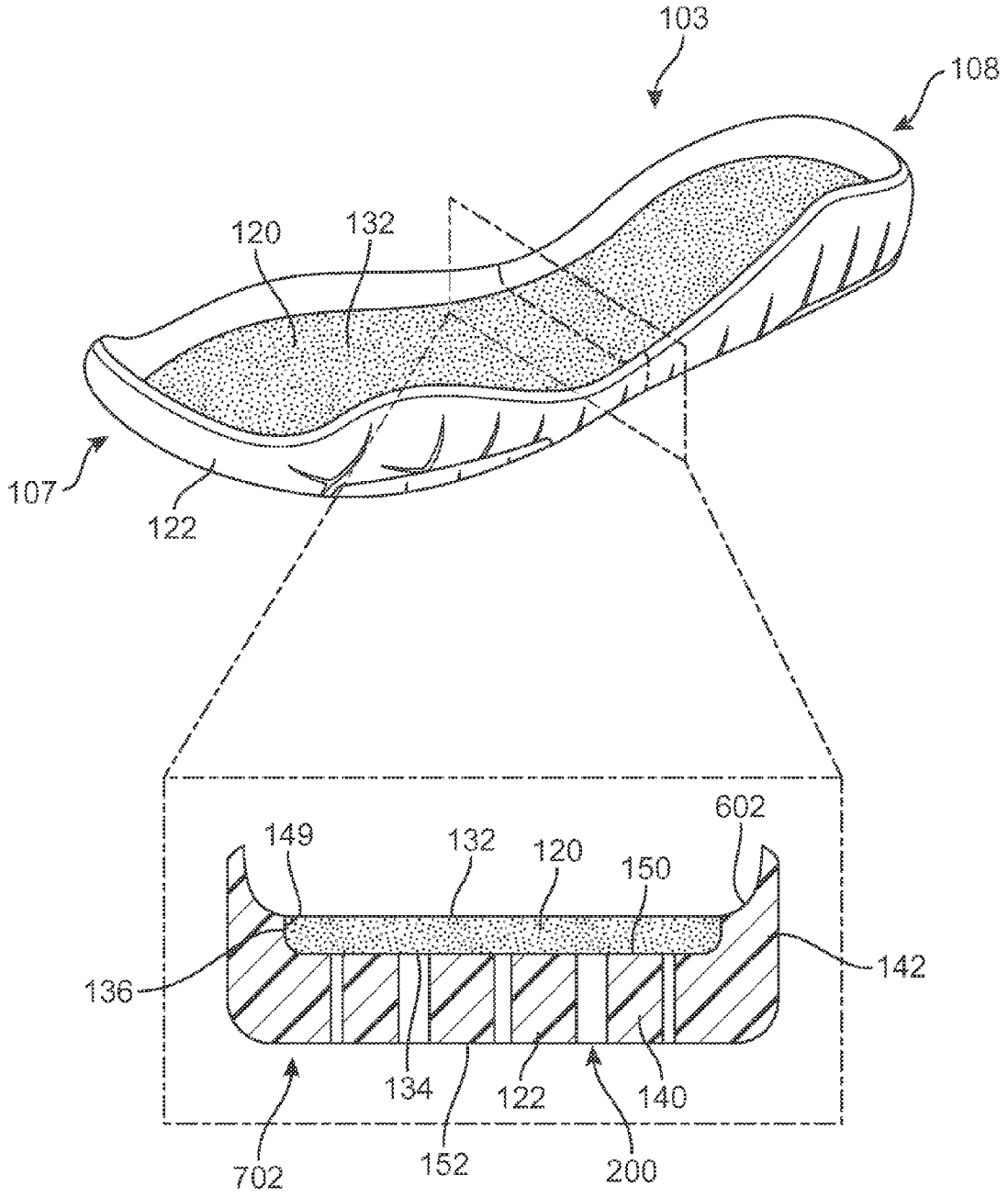
FIG. 6 is a schematic isometric view of an embodiment of a sole structure including a midsole component and an inner sole component.

FIG. 6 illustrates an isometric view of sole structure 103 with inner sole component 120 assembled with midsole component 122, including an enlarged cross-sectional view of the two components. As seen in FIG. 6, inner sole component 120 fits snugly within central recess 148 (see FIG. 2). Specifically, the fit is configured so that outer surface 134 of inner sole component 120 is disposed against inner surface 150 of midsole component 122 and peripheral sidewall surface 136 of inner sole component 120 is disposed against inner recess sidewall 149 of midsole component 122.

As seen in FIG. 6, inner surface 150 of midsole component 122 includes an inner peripheral surface 602 that comprises the inner surface of sidewall portion 142 of midsole component 122. In at least some embodiments, inner sole component 120 may be flush with a surface of midsole component 122. In an exemplary embodiment, inner surface 132 of inner sole component 120 may be flush, or approximately flush, with inner peripheral surface 602 of midsole component 122. Such a flush configuration may provide a unitary feel for inner sole component 120 and midsole component 122 against a foot (possibly mediated by a sock and/or additional liners). Of course, in other embodiments, inner surface 132 could be raised above inner peripheral surface 602. In still other embodiments, inner surface could be recessed below inner peripheral surface 602.

Figure 7:
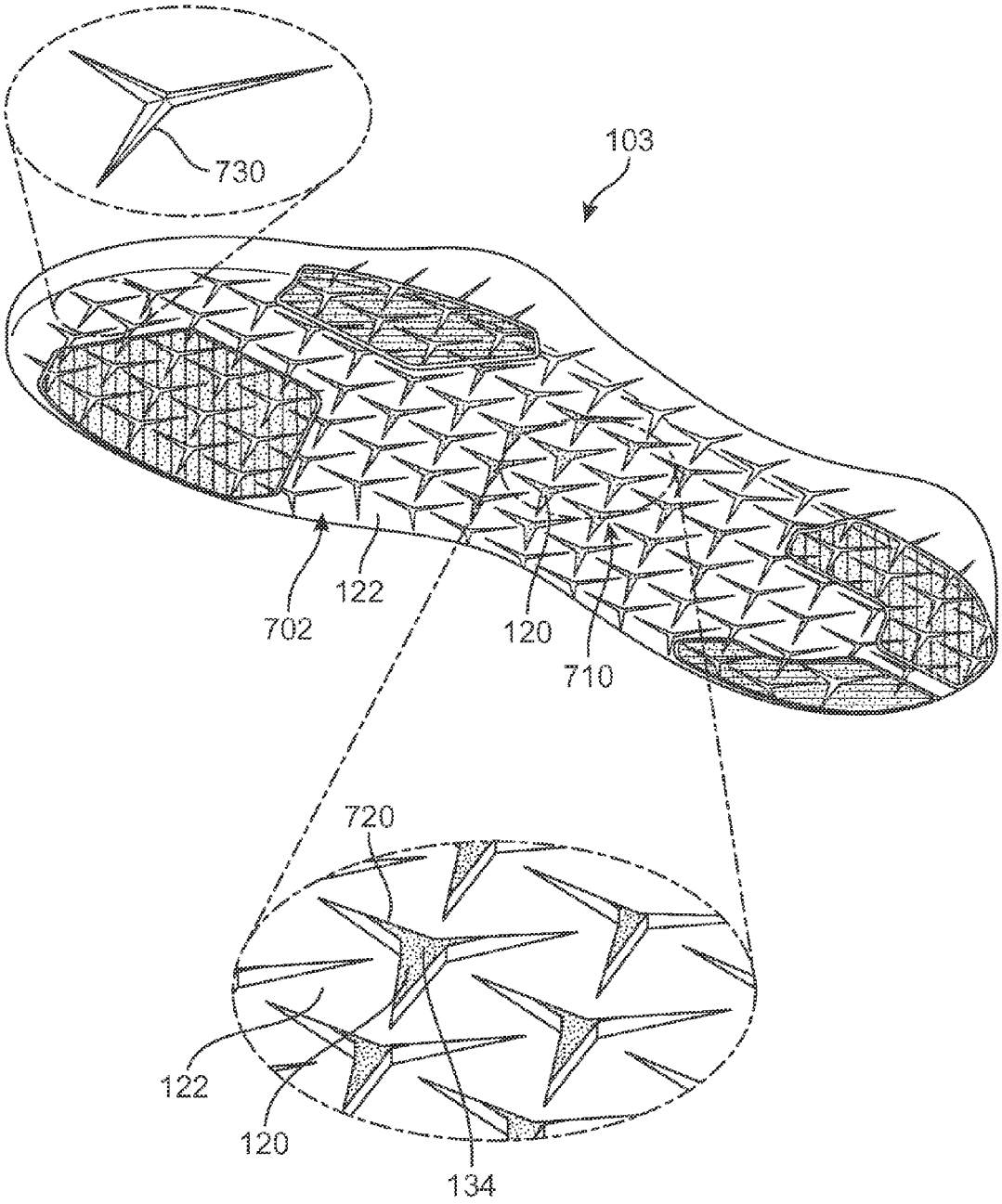
FIG. 7 is a bottom isometric view of an embodiment of the sole structure of FIG. 6.

FIG. 7 illustrates a bottom isometric view of sole structure 103, including an enlarged view of several holes in midsole component 122. Referring now to FIGS. 6-7, inner sole component 120 may be at least partially exposed on a lower surface 702 of sole structure 103. In the exemplary embodiment, plurality of holes 200 may include a set of through holes 710 that extend through the entire thickness of midsole component 122 (i.e., between outer surface 152 and inner surface 150). That is, the holes in set of through holes 710 are open to central recess 148 on inner surface 150. The result of this configuration is that some portions of inner sole component 120 may be visible through set of through holes 710.

As shown in FIG. 7, a representative through hole 720 extends through the entire thickness of midsole component 122. Therefore, outer surface 134 of inner sole component 120 is visible within through hole 720, as well as within other holes of set of through holes 710. It may also be appreciated that some holes are not through holes (i.e., some holes may be blind holes) so that inner sole component 120 may not be visible through such blind holes. For example, a blind hole 730 may be visible on midsole component 122. As seen in FIG. 7, inner sole component 120 is not visible through blind hole 730.

In at least some embodiments, midsole component 122 and inner sole component 120 could have different colors. For example, in one embodiment, midsole component 122 may be green while inner sole component 120 could be red. Since inner sole component 120 may be partially visible, or exposed, through some holes on midsole component 122, this may provide a pleasing aesthetic effect on an outer surface of sole structure 103.

In different embodiments, the physical characteristics of layers or components in a dual layer structure may vary. In some embodiments, an inner sole component and a midsole component could have similar physical characteristics. In other embodiments, an inner sole component and a midsole component could have different physical characteristics and/or may be made from different materials.

In at least some embodiments, inner sole component 120 and midsole component 122 may have different values of compressibility. As used herein, the term compressibility refers to the degree to which an object compresses in volume under a compressive force. In some embodiments, midsole component 122 could be less compressible than inner sole component 120. In other embodiments, midsole component 122 could be more compressible than inner sole component 120. In the exemplary embodiment illustrated in FIGS. 6-9, inner sole component 120 may be more compressible than midsole component 122 so that inner sole component provides improved cushioning and contouring for a foot within article 100.

Figure 8:
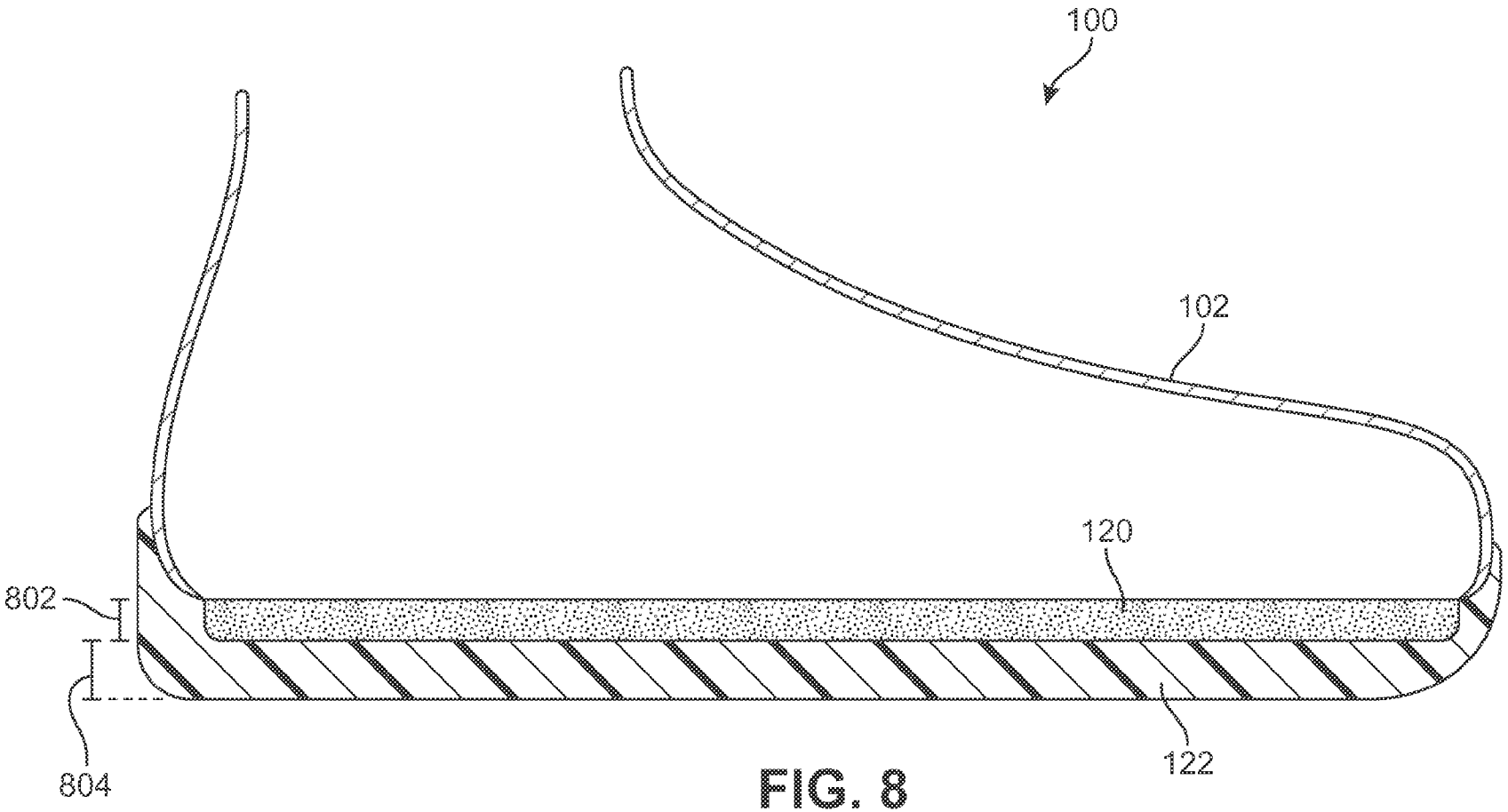
FIG. 8 is a schematic side cross-sectional view of an article of footwear before a foot has been inserted.
Figure 9:
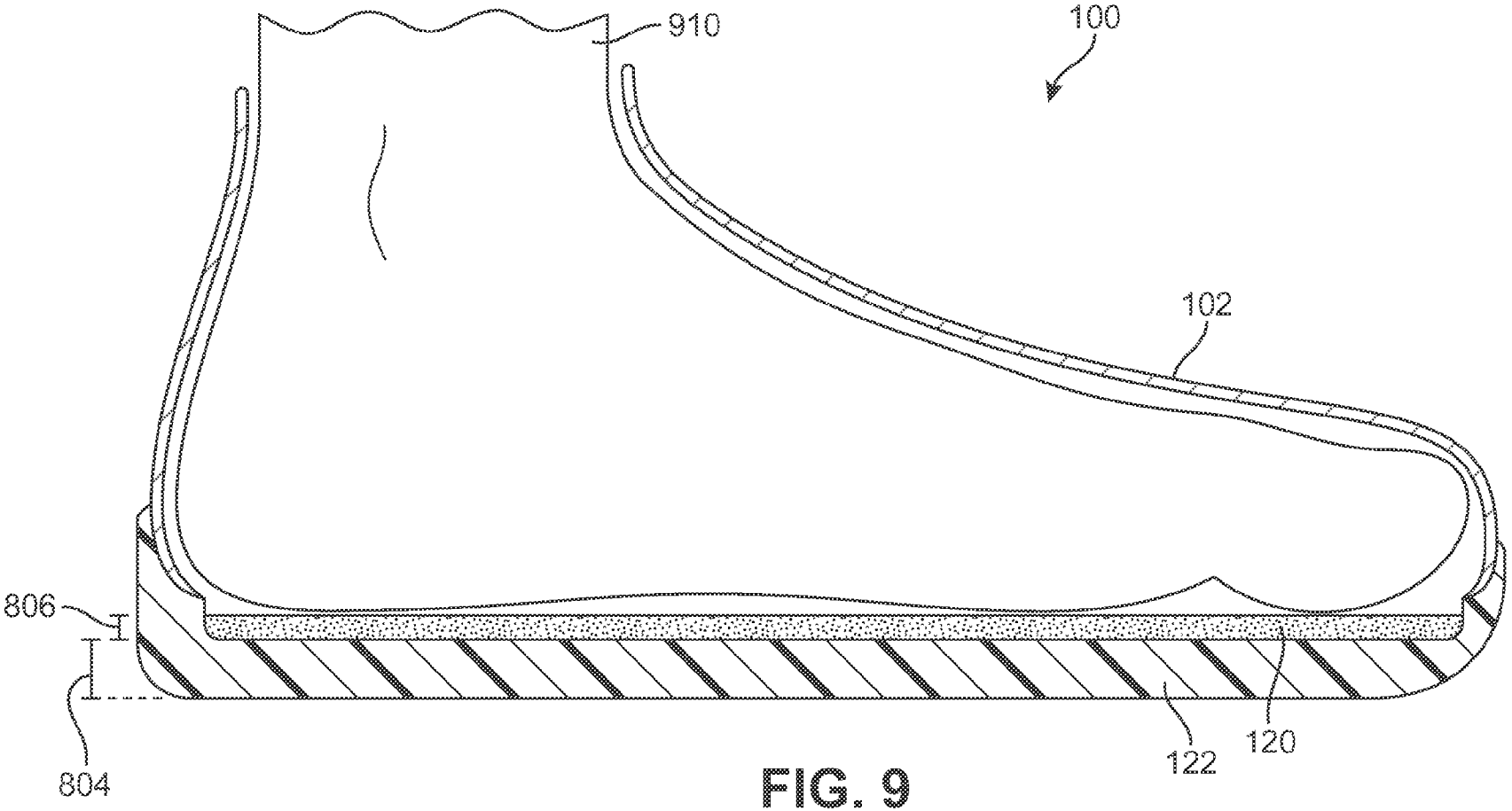
FIG. 9 is a schematic side cross-sectional view of an article of footwear while a foot is inserted.

FIGS. 8 and 9 illustrate side cross-sectional views of an embodiment of article 100 that includes inner sole component 120 and midsole component 122. Without a foot in article 100 inner sole component 120 and midsole component 122 have an uncompressed configuration, as shown in FIG. 8. In this uncompressed configuration, inner sole component 120 has a thickness 802 while midsole component 122 has a thickness 804.

As a foot is inserted into article 100, the weight of the user (with or without additional forces) may apply a compressive force to sole structure 103, thereby compressing inner sole component 120. For example, a foot 910 applies a compressive force against sole structure 103, thereby compressing inner sole component 120 from an initial thickness 802 to a compressed thickness 806. In contrast, midsole component 122, which may be less compressible than inner sole component 120, may not undergo much change in thickness. As seen in FIG. 9, midsole component 122 has an approximately unchanged thickness 804.

In some embodiments, the density of an inner sole component and a midsole component could vary. In some embodiments, an inner sole component could have a similar density to a midsole component. In other embodiments, an inner sole component could have a different density than a midsole component. In the exemplary embodiment of FIGS. 8-9, inner sole component 120 could have a different density than midsole component 122. For example, in the exemplary embodiment, inner sole component 120 could be made of a less dense material than midsole component 122. As one example, midsole component 122 could be made of a material including a high-density foam while inner sole component 120 could be made of a material including a low-density foam. This provides a dual density configuration for sole structure 110, where the higher density of midsole component 122 may provide improved durability on an outer side of sole structure 110.

It will be understood that in some materials, density and firmness may be related, such that materials with lower density may be less compressible than similar materials with higher density. However, some materials, such as some foams, may have densities that are independent of their compressibility. It may therefore be appreciated that in some embodiments, an inner sole component could vary in density and/or compressibility.

It may be further appreciated that in some embodiments one or more outer sole members could differ in density from either an inner sole component or a midsole component. For example, in one embodiment, outer sole members 124 may have a greater density than both inner sole component 120 and midsole component 122, thereby providing further durability in the regions where traction with a ground surface is intended to be the greatest.

Figure 10:
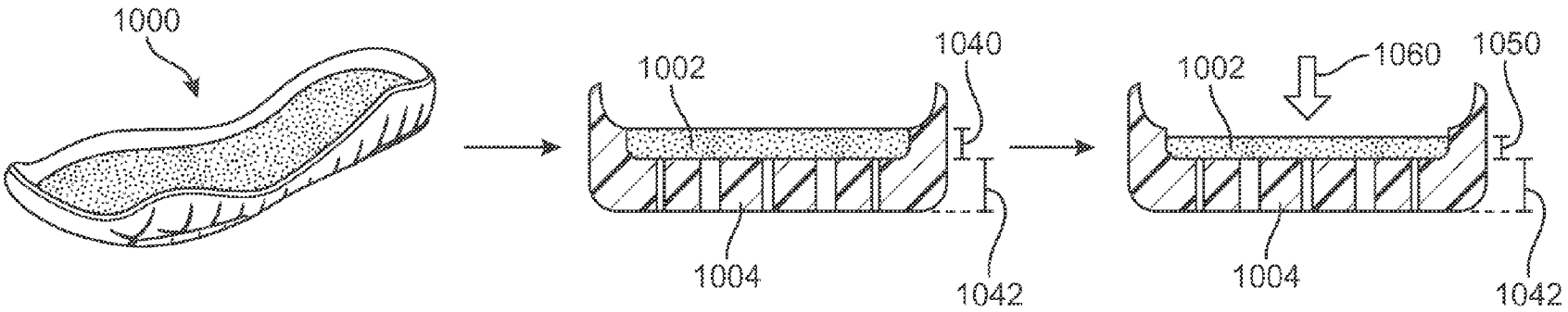
FIGS. 10-12 illustrate schematic views of various material configurations for a midsole component and an inner sole component that comprise a midsole assembly.
Figure 11:
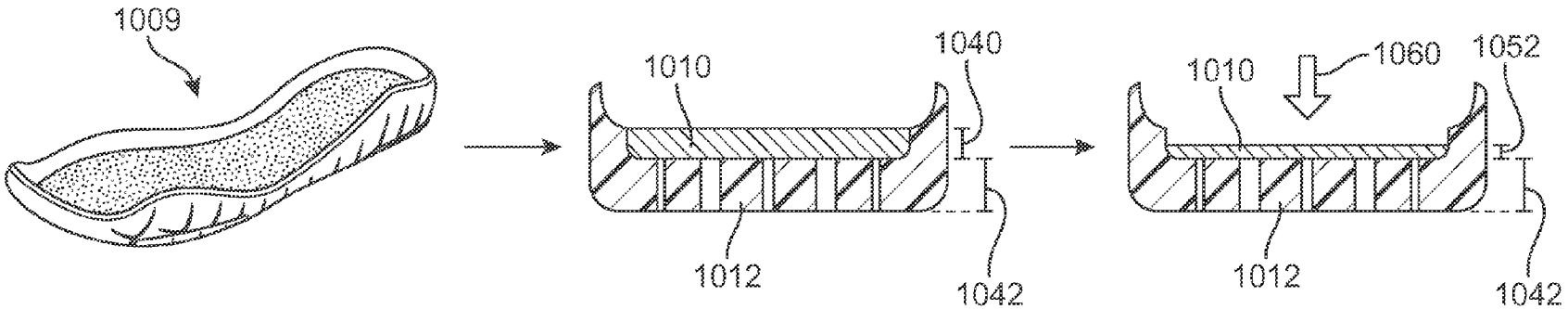
Figure 12:
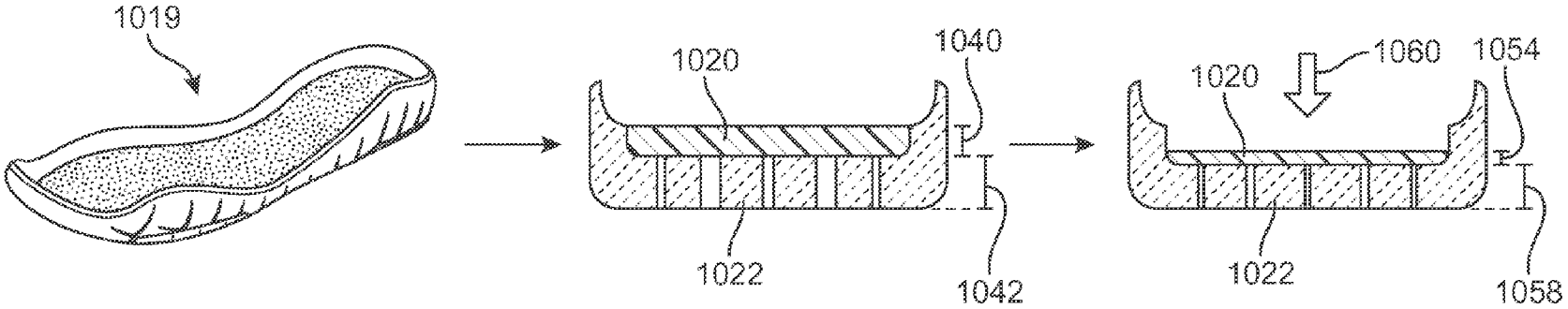

FIGS. 10-12 illustrate schematic views of several distinct embodiments of sole structures utilizing different physical properties for an inner sole component and a midsole component. In FIG. 10, a sole structure 1000 includes a midsole component 1004 and an inner sole component 1002. In FIG. 11, a sole structure 1009 includes a midsole component 1012 and an inner sole component 1010. In FIG. 12, a sole structure 1019 includes a midsole component 1022 and an inner sole component 1020. In FIGS. 10 and 11, midsole component 1004 and midsole component 1012 may be made of the same material having the same compressibility. However, inner sole component 1002 may be made of a different material than inner sole component 1010, which may provide inner sole component 1002 with a different compressibility than inner sole component 1010. As seen in FIGS. 10-11, under a compressing force 1060, midsole component 1004 and midsole component 1012 do not visibly compress, retaining a consistent thickness 1042 before and after compression. In contrast, inner sole component 1002 and inner sole component 1010 both undergo compression. However, inner sole component 1002 compresses to a thickness 1050 which is greater than the thickness 1052 to which inner sole component 1010 compresses.

FIG. 12 illustrates an embodiment where both a midsole component and an insole component undergo compression. As shown in FIG. 12, midsole component 1022 is made of a different material from midsole component 1004 or midsole component 1012. As sole structure 1019 is subjected to compressive force 1060, both inner sole component 1020 and midsole component 1022 are compressed to a thickness 1054 and a thickness 1058, respectively. As shown in FIG. 12, inner sole component 1020 undergoes a greater degree of compression than midsole component 1022.

Embodiments can use any methods for making dual component sole structures, such as dual density, or dual compressibility, sole structures. Some embodiments could utilize unit sole injection methods, various other kinds of injection molding methods and/or blow molding methods. Moreover, in some cases the inner sole and midsole components could be molded simultaneously, while in other cases they may be molded separately and glued together.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A sole structure, comprising:

a midsole component and an inner sole component;

the midsole component having a longitudinal direction extending along a length of the sole structure, a lateral direction extending along a width of the sole structure, and a vertical direction that is perpendicular to the longitudinal direction and the lateral direction;

the midsole component including a plurality of holes arranged in an auxetic configuration;

wherein the auxetic configuration is configured such that when the midsole component is under longitudinal tension it expands in both the longitudinal direction and the lateral direction and when the midsole component is under lateral tension it expands in both the lateral direction and the longitudinal direction;

wherein the plurality of holes includes at least one through hole that extends through a thickness of the midsole component in the vertical direction between an inner surface and an outer surface of the midsole component;

the midsole component being shaped to receive the inner sole component, wherein the inner sole component is disposed against the inner surface of the midsole component; and wherein a first density of the midsole component is different than a second density of the inner sole component.

2. The sole structure according to claim 1, wherein the midsole component includes a recess on the inner surface that receives the inner sole component.

3. The sole structure according to claim 2, wherein the recess further includes an inner recess sidewall extending around the recess; and wherein a peripheral sidewall surface of the inner sole component is disposed against the inner recess sidewall of the midsole component.

4. The sole structure according to claim 3, wherein a portion of the inner sole component is exposed through the at least one hole.

5. The sole structure according to claim 4, wherein the midsole component is a different color than the inner sole component.

6. The sole structure according to claim 3, wherein at least one hole of the plurality of holes is a blind hole.

7. The sole structure according to claim 1, wherein the midsole component has a higher density than the inner sole component.

8. The sole structure according to claim 1, wherein the midsole component is made of a material including foam.

9. The sole structure according to claim 8, wherein the inner sole component is made of a material including foam.

10. The sole structure according to claim 1, wherein the inner sole component is more compressible than the midsole component.

11. An article of footwear, comprising:

an upper;

a sole structure including a midsole component and an inner sole component;

the midsole component having a longitudinal direction extending along a length of the article of footwear, a lateral direction extending along a width of the article of footwear, and a vertical direction that is perpendicular to the longitudinal direction and the lateral direction;

the midsole component including an outer surface and an inner surface;

the outer surface including a plurality of holes arranged in an auxetic configuration;

wherein the auxetic configuration is configured such that when the midsole component is under longitudinal tension it expands in both the longitudinal direction and the lateral direction and when the midsole component is under lateral tension it expands in both the lateral direction and the longitudinal direction;

wherein the plurality of holes includes at least one through hole that extends through a thickness of the midsole component in the vertical direction between the inner surface and the outer surface of the midsole component;

the inner surface of the midsole component including a central recess that receives the inner sole component; and at least one outer sole member attached to the outer surface of the midsole component.

12. The article of footwear according to claim 11, wherein the central recess has a first geometry, wherein the inner sole component has a second geometry and wherein the first geometry matches the second geometry.

13. The article of footwear according to claim 11, wherein an inner surface of the inner sole component is flush with a portion of the inner surface of the midsole component.

14. The article of footwear according to claim 11, wherein the central recess extends from a front end of the midsole component to a rear end of the midsole component.

15. The article of footwear according to claim 11, wherein the inner sole component is more compressible than the midsole component.

16. The article of footwear according to claim 11, wherein the inner sole component is exposed on the outer surface of the sole structure through at least one hole in the midsole component.

17. The article of footwear according to claim 11, wherein the at least one outer sole member has a different density than the inner sole component.

18. The article of footwear according to claim 11, wherein the at least one outer sole member has a different density than the midsole component.

19. The article of footwear according to claim 11, wherein the at least one outer sole member is disposed in a recess on the outer surface of the midsole component.

20. The article of footwear according to claim 11, wherein the midsole component is thicker than the inner sole component proximate the central recess.

* * * * *